United States Patent [19]

Choksi et al.

[11] 4,015,400

[45] * Apr. 5, 1977

[54] METHOD OF OPENING MEDICAL LIQUID CONTAINER WITH SEPARABLE OUTER AND INNER CLOSURES

[75] Inventors: Pradip V. Choksi, North Hollywood; Roy B. Steidley, Seal Beach, both of Calif.

[73] Assignee: American Hospital Supply Corporation, Evanston, Ill.

[ * ] Notice: The portion of the term of this patent subsequent to Apr. 20, 1993, has been disclaimed.

[22] Filed: Sept. 15, 1975

[21] Appl. No.: 613,635

Related U.S. Application Data

[62] Division of Ser. No. 338,662, Mar. 7, 1973, U.S. Pat. No. 3,923,183.

[52] U.S. Cl. ..... 53/3; 53/381 A

[51] Int. Cl.[2] ..... B65B 43/40

[58] Field of Search ..... 53/3, 381 R, 381 A; 215/251, 253; 220/265–269

[56] References Cited

UNITED STATES PATENTS

| | | | |
|---|---|---|---|
| 3,419,172 | 12/1968 | Lee | 215/32 |
| 3,664,536 | 5/1972 | Emery | 215/251 |
| 3,730,372 | 5/1973 | Komendowski | 215/32 |
| 3,820,675 | 6/1974 | Malles | 215/9 |

*Primary Examiner*—Travis S. McGehee
*Assistant Examiner*—J. Sipos
*Attorney, Agent, or Firm*—Y. Judd Azulay; Larry Barger

[57] ABSTRACT

A thermoplastic bottle for sterile medical liquids with a dispensing outlet closed off by an inner closure. An outer closure in the form of a thermoplastic cap overlies the inner closure. During steam sterilization at 240° to 260° F (116° to 127° C) the outer cap deflects inwardly against the inner cap to force the inner cap into a tighter seal against the bottle. This outer cap includes external left-handed threads and has a lateral frangible brim fused to the thermoplastic bottle. A threaded jacking ring is screwed onto the outer cap and with a counterclockwise motion acts to (1) fracture the cap's external brim and (2) separate the outer cap from the sealed inner cap.

5 Claims, 11 Drawing Figures

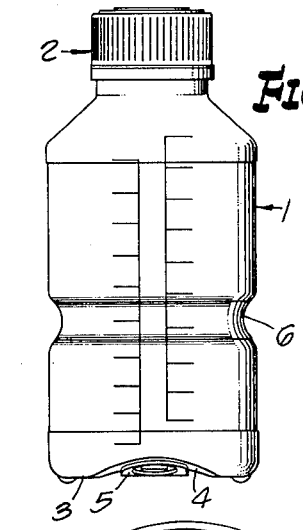
FIG. 1.
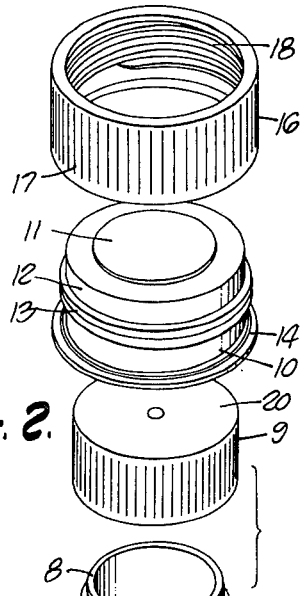
FIG. 2.
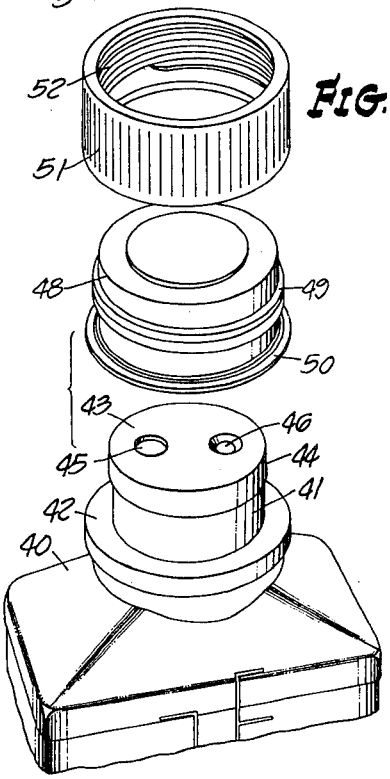
FIG. 6.
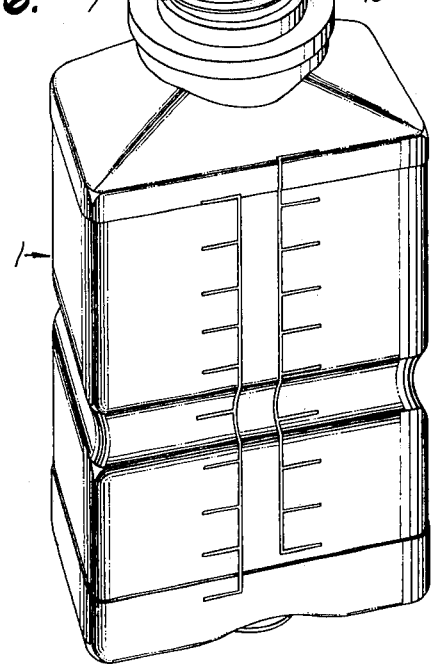

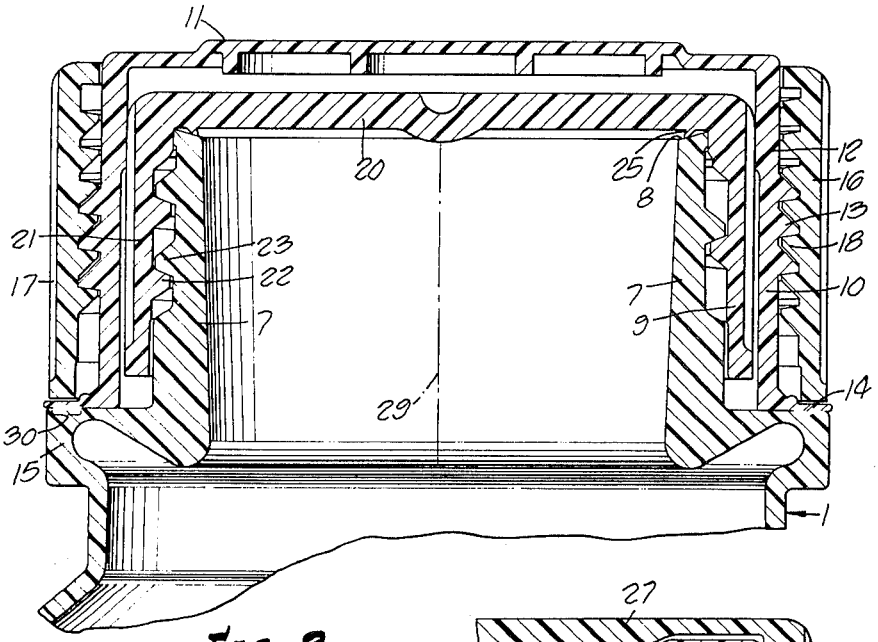
FIG. 3.
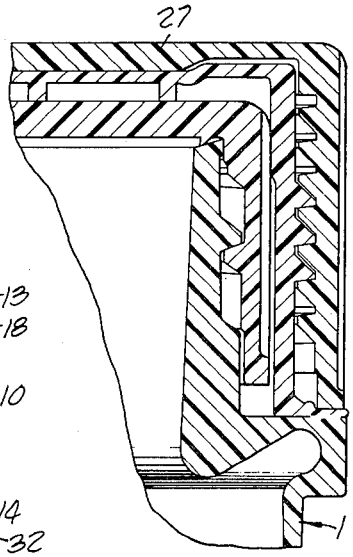
FIG. 5a.
FIG. 4.
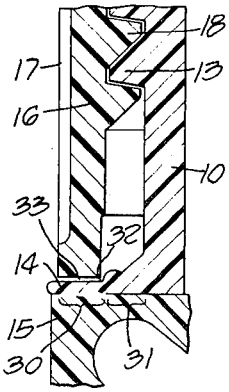
FIG. 5.
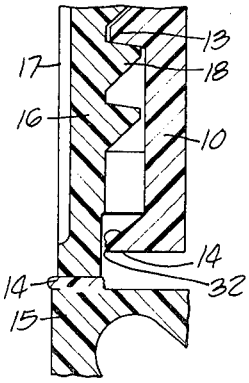

METHOD OF OPENING MEDICAL LIQUID CONTAINER WITH SEPARABLE OUTER AND INNER CLOSURES

This is a division, of application Ser. No. 338,662 filed Mar. 7, 1973 now U.S. Pat. No. 3,923,183.

BACKGROUND

Sterile medical liquids such as 5% dextrose, normal saline, sterile water, etc., are often bottled and sterilized by manufacturers and then shipped to hospitals. When ready for use these bottles are opened to dispense sterile irrigating liquids to a surgical wound, or to deliver intravenous liquid into a patient's vein.

A very critical portion of these sterile medical liquid containers is their closure system which protects the dispensing outlet of these containers. Such a closure system must maintain the sterility of the dispensing outlet.

It has been proposed in the past to use double closure systems in which an outer closure fits over and protects a sterile inner closure of the container. In some situations it is desirable to separately remove the outer closure from the inner closure. Then in a subsequent step all or part of the sterile inner closure can be removed to dispense the sterile medical liquid from the container. Sometimes the inner closure is replaceable or reclosable when only a portion of the bottle's contents are dispensed.

While these previous double closure systems with an outer closure separable from the inner closure performed the primary function of protecting the sterility of the dispensing outlet, they were often hard to open. This was because the outer closure required some unusual hand movements and an unusual sequence of steps that the nurse or physician had to remember.

SUMMARY OF THE INVENTION

This invention provides an improved double closure system with a separately removable outer cap that fits over an inner cap. When steam sterilized the outer cap deflects inwardly to urge the inner cap into a tighter seal with the bottle. The closure both protects the sterility of the dispensing outlet, and is also easy to open. A counterclockwise motion of a special jacking ring fractures the outer cap at a frangible brim which is hermetically sealed to the bottle. The combined jacking ring and outer cap are then removed from the inner closure. To a nurse or physician, this is an extremely simple motion. They are accustomed to this motion because it is commonly used for opening various household containers such as toothpaste, jars of food, etc. No special series of pushing, pulling, sliding steps, etc., need be remembered.

The special double closure system with separable outer cap is better understood with reference to the attached drawings.

THE DRAWINGS

FIG. 1 is a front elevational view of the container and first embodiment of the closure system of our invention as it is sealed and stored at a hospital ready for use;

FIG. 2 is an exploded perspective view of the various elements of the closure system of the first embodiment used for a pouring container;

FIG. 3 is an enlarged sectional view of the pouring container closure of FIG. 2 with the closure elements assembled;

FIG. 4 is a further enlarged sectional view of the left side portion of FIG. 3 showing the frangible brim section of the outer cap before fracturing;

FIG. 5 is an enlarged sectional view similar to FIG. 4 but showing the frangible brim after fracture;

Figure 7:
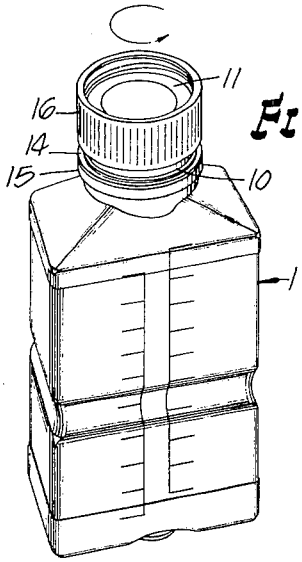

FIG. 5*a* is an enlarged sectional view of a right side portion of another embodiment of the invention showing the jacking ring having a closed top;

FIG. 6 is an enlarged exploded perspective view of a second embodiment of the double closure system of this invention showing an inner closure adapted to connect with an intravenous administration set; and FIGS. 7 to 10 illustrate the sequence of steps of opening the pouring container illustrated in FIG. 3.

DETAILED DESCRIPTION

With reference to these drawings, FIG. 1 shows a blow-molded thermoplastic bottle 1 with a closure system generally indicated at 2 at its upper end. At its lower end is a supporting base 3 with an indented center portion 4. A hinged hanger 5 fits within indented portion 4 for suspending the container upside down if desired. An indented waist section 6 provides a convenient grippable portion of the bottle.

The closure system of the bottle is shown in much greater detail in FIG. 2. Here the bottle 1 is shown with a threaded tubular neck 7 surrounded by a pouring lip 8. In this first embodiment of the invention, the container is generally referred to as a "pouring container." The sterile medical liquid contained within the bottle 1 is simply poured into a surgical wound for flushing, etc. Since the pouring lip 8 becomes touched by liquid poured from the bottle, it is extremely important to have a very reliable closure system.

The closure system fitting onto the tubular neck includes two caps. One cap is an internally threaded screw cap 9 that is received on threaded neck 7 and forms an annular inner hermetic seal with this neck. The other is an outer cap 10 that fits over the inner cap and includes a top wall 11 and a depending skirt 12 with external threads 13. At a lower end of outer cap 10 is a laterally extending frangible brim 14. This brim is 0.005 to 0.050 inch (0.13 to 1.3 millimeters) thick, and is fused to a flange 15 of the bottle. The fusion joint between the frangible brim 14 and flange 15 forms an annular outer hermetic seal. Thus, there are two annular hermetic seals in this closure system.

The uppermost element in FIG. 2 is a threaded jacking ring 16. This jacking ring includes a knurled or grooved outer surface 17 for easy gripping. Internally of the annular jacking ring 16 are integral left-handed threads 18. When the closure of FIG. 2 is assembled, the threads 18 intermesh with the left-handed threads 13 of the outer cap. Thus, counterclockwise rotation of the jacking ring 16 relative to the outer cap screws the jacking ring downwardly on the outer cap.

FIG. 3 is an enlarged sectional view showing the jacking ring 16, the outer cap 10 and the inner cap 9 assembled on the dispensing neck 7. Here the inner cap 9, with a top wall 20 and a depending skirt 21, has internal right-handed threads 22 that engage right-handed 23 of the dispensing neck. At a top of the dispensing neck 7 is a pouring lip 8. The top wall 20 of the inner cap 9 includes an integral deformable rib 25 that compressingly engages this pouring lip 8. This forms the annular inner hermetic seal. Even if the bottle is turned upside down, the sterile liquid confined within bottle 1 will not seep past this inner hermetic seal.

To maintain this inner hermetic seal it is very important that rib 25 be very tightly squeezed against lip 8 of the container neck. The screw threads 22 of the inner cap exert this squeezing pressure. It has also been found that additional downward pressure on the inner cap makes an even tighter seal at rib 25. This can be done by including a top 27 on the jacking ring that pushes downwardly on the outer cap's top wall which in turn pushes on the inner cap's top wall to increase the pressure at rib 25. FIG. 5*a* illustrates this.

The added pressure on rib 25 can also be accomplished in a steam autoclave. When a bottle closure such as shown in FIG. 3 is steam autoclaved the pressure in the autoclave forces top wall 11 of the outer closure to deflect downwardly and firmly press on the inner cap. This increases the sealing force at rib 25 during autoclaving. Thus, the added pressure on rib 25 can be applied with a jacking ring that has no closed top.

The outer closure 10 with its top wall 11 and depending skirt 12 has integral external threads 13 and a frangible brim 14. This frangible brim 14 is at a lower end of the outer cap and externally protrudes in a plane generally perpendicular to a common longitudinal axis 29 through dispensing neck 7 and outer cap 10. The frangible brim has an outer annular portion 30 that is fusion bonded to a top surface of lateral flange 15 on the bottle. The top surface of this flange 15 lies in a plane generally perpendicular to longitudinal axis 29.

FIG. 4 shows an enlarged fragmentary sectional view of the annular fused zone 30 along an outer portion of frangible brim 14. There is also an inner annular band 31 that remains unfused to the flange 15. This unfused portion 31 joins the fused portion 30 at a weakened fracturable line 32 extending around the frangible brim. As rotated counterclockwise a lower end surface 33 of the jacking ring contacts the frangible brim. The jacking ring has a sharp inner edge of its bottom surface that helps concentrate the downward forces adjacent fracturable line 32. Further clockwise movement of the jacking ring 16 as shown in FIG. 5 pulls the outer cap upwardly until the frangible brim 14 fractures at fracturable line 32. When this happens the combined jacking ring 17 and outer closure 10 can be removed from the inner cap. This is because there is a slight annular space between inner cap skirt 21 and outer cap skirt 12 so there is no substantial frictional engagement between the outer cap and the inner cap. Therefore if the outer cap is further rotated after the fracture at 32, then the outer cap will not loosen the inner cap.

Once the outer cap has been fractured with the jacking ring and lifted therefrom, the inner cap can be unscrewed in a separate step with a counterclockwise rotational movement. This inner cap can then be replaced on the threaded neck of the container if desired.

In FIG. 6 there is shown a second embodiment of our invention. Here a container 40 is shown with a neck 41 surrounded by a flange 42. There is no threaded screw cap on neck 41. Instead, in this embodiment there is a transverse wall member 43 permanently sealed to neck 41. If desired, wall member 43 can include a depending skirt 44 that is fused or otherwise bonded to neck 41.

This transverse wall 43 has an openable portion for gaining access to its sterile liquid contents. The openable portion can be a puncturable diaphragm 45, adapted to be broken by a pointed spike of a sterile intravenous administration set. Internally the puncturable diaphragm 45 is a tubular gripping member (not shown) for hermetically sealing against such a spike. A puncturable resealable rubber diaphragm 45 for adding additional medicaments can be secured to the wall member 43.

Fitting over the inner closure of the second embodiment of FIG. 6 is an outer cap 48. This cap includes a skirt with left-handed threads 49 and a frangible brim 50 that is bonded to flange 42 of the bottle. The outer cap structure is similar to the outer cap in the first embodiment of FIG. 3. There is also a threaded jacking ring 51 with internal left-handed threads 52 as in the first embodiment.

FIGS. 7 to 10 show the method of opening the double closure system of this invention. In these figures, the first embodiment is shown. In FIG. 7 the first step is to rotate the annular jacking ring 16 counterclockwise to tighten it down against the frangible brim 14 that has been bonded to flange 15. Usually the jacking ring is closely spaced to frangible brim 14 so the downward motion is imperceptible to the nurse or physician. To them, they are simply unscrewing the cap in a normal manner.

Figure 8:
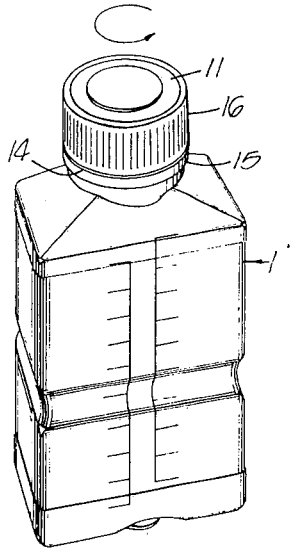
Figure 9:
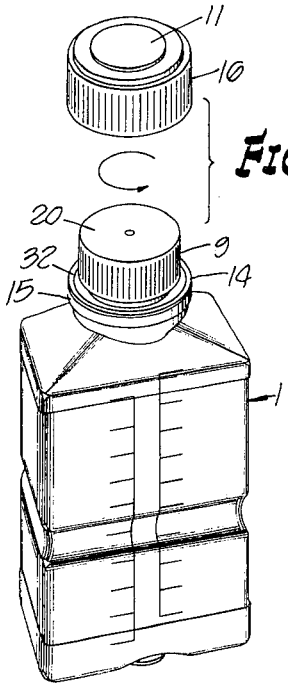
Figure 10:
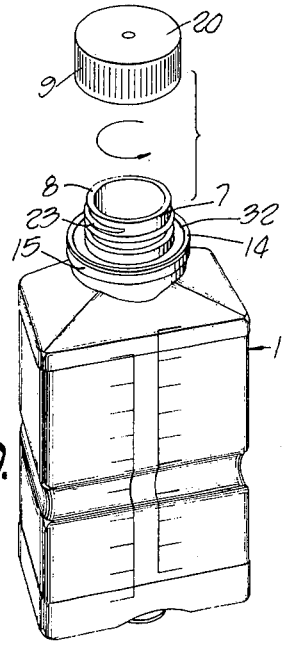

In FIG. 8 continued counterclockwise movement of the jacket ring 16 causes a strain at the frangible brim. This fractures the frangible brim at an annular fracture line. When this happens, the combined jacking ring and outer cap are lifted from the inner cap 9 as shown in FIG. 9. Since the inner cap 9 and outer cap 10 have a slight space therebetween, rotation of the outer cap does not loosen the inner cap. In a separate step the inner cap 9 is removed by a counterclockwise unscrewing motion. Then the container in FIG. 10 is ready for pouring.

The procedure as shown above in FIGS. 7 through 9 is identical for the second embodiment container. However, with the second embodiment container the inner cap is not unscrewed. Instead, an intravenous administration set is connected to the inner cap.

In opening procedures for both of these containers the manual motions are extremely simple. The nurse or physician is accustomed to turning a cap by turning it in a counterclockwise direction. The operator need not be concerned with the inner workings, the fracturing stresses, etc., that are created by this simple motion. Thus, this invention creates a closure system that is both easy to open and provides a separately removable outer cap and an inner cap that form double sterility protecting closures.

In the two embodiments shown, very good results have been obtained when the bottle is blow-molded of a polyallomer thermoplastic that is a propylene-ethylene copolymer, and the outer caps of both embodiments are injection-molded of the same propylene-ethylene copolymer material. Such a material is marketed by Eastman Chemical Company under the name of Tenite. Using the same material for both the outer cap and the bottle aids in the heat fusion joint at the frangible brim. The inner cap of the first embodiment, the inner cap of the second embodiment, and the jacking ring of either embodiment can be made of suitable thermoplastic material.

In the foregoing specification and drawings specific embodiments have been used to describe the invention. However, it is understood by those skilled in the art that certain modifications can be made to these embodiments without departing from the spirit and scope of the invention.

We claim:

1. A method of opening a sterile medical liquid container with a dispensing outlet closed by an inner closure and an outer externally threaded cap bonded to the container comprising the steps of:

rotating an internally threaded annular ring in a given direction to screw this ring onto the outer cap with said ring being totally free of any contact with said inner closure;

further rotating the annular ring in the same direction for fracturing the outer cap;

lifting the combined threaded ring and outer cap from the inner closure;

and thereafter opening the inner closure after the threaded ring and outer closure have been completely separated therefrom.

2. The method as set forth in claim 1 wherein the method includes rotating the annular ring in a counterclockwise direction.

3. The method as set forth in claim 1 wherein the inner cap is removed with a counterclockwise rotational motion.

4. The method as set forth in claim 1 wherein the first step of threadingly screwing the threaded ring onto the outer cap is performed prior to transporting and storing the sealed container; and the step of fracturing the outer cap and lifting the combined threaded ring and outer cap from the inner closure is performed immediately prior to dispensing the contents of the container.

5. A method of opening a blow molded thermoplastic bottle containing a sterile medical liquid, which bottle has a dispensing outlet surrounded by a lateral external flange, and this outlet is hermetically sealed by an inner closure, and there is an injection molded thermoplastic outer cap encasing the inner closure, which outer cap has external threads, a frangible section and a lateral brim fused to the bottle flange, said method comprising the steps of:

a. rotating an internally threaded jacking ring in a given direction to screw this jacking ring unto the outer cap's external threads until this ring contacts the outer cap's brim fused to the bottle flange, with said jacking ring being totally free of any contact with said inner closure;

b. further rotating the jacket ring in the same direction to slidingly engage the outer cap's brim to fracture the outer cap at its frangible section without rupturing either the blow molded bottle or the inner closure, whereby the bottle can be oriented in any position during the outer cap fracturing process without any contamination of the bottle's sterile liquid contents by either the jacking ring or the outer cap;

c. rotating the outer cap during removal without substantial frictional contact with the inner cap;

d. separating from the inner cap, the combined jacking ring and portion of the outer cap threadingly engaged in the jacking ring; and d. removing at least a portion of the inner closure for dispensing the bottle's sterile liquid contents.

* * * * *